US005967483A

United States Patent [19]

Liberfarb et al.

[11] Patent Number: 5,967,483

[45] Date of Patent: Oct. 19, 1999

[54] NON-PASSIVE COPY HOLDER WITH ROTATABLE DRUM

[76] Inventors: Sidney Liberfarb; Florence Liberfarb, both of 54 Harrington Farms, Shrewsbury, Mass. 01545

[21] Appl. No.: 08/542,669

[22] Filed: Oct. 13, 1995

[51] Int. Cl.[6] ..... B41J 29/00

[52] U.S. Cl. ..... 248/441.1; 400/718

[58] Field of Search ..... 248/441.1, 444.4, 248/450, 451, 458, 346.03, 346.04; 40/348, 514; 400/718; 242/300

[56] References Cited

U.S. PATENT DOCUMENTS

| | | | |
|---|---|---|---|
| 496,090 | 4/1893 | Murray | 403/348 |
| 854,478 | 5/1907 | Ford | 400/718 |
| 1,333,803 | 3/1920 | Freet | 40/348 |
| 1,573,237 | 2/1926 | Forney | 400/718 X |
| 1,700,629 | 1/1929 | Douglas | 400/718 X |
| 1,855,286 | 4/1932 | Giese | 40/348 |
| 1,970,770 | 8/1934 | Richards | 40/348 |
| 2,476,775 | 7/1949 | Sindelar | 40/348 |
| 4,558,527 | 12/1985 | Schroedel et al. | 400/718 X |
| 5,201,596 | 4/1993 | Yang | 400/718 |

*Primary Examiner*—Ramon O. Ramirez
*Assistant Examiner*—Anita M. King
*Attorney, Agent, or Firm*—Brian M. Dingman

[57] ABSTRACT

A rotatable, free standing copy holder with a relatively narrow base structure upon which is mounted a cylindrical drum to which sheets of standard office size paper containing written or printed information may be clamped at the top margin. The configuration of the base permits the lower portion of the sheet of copy to be tucked in a loose roll into the open space in the base under the drum. To scan the sheet of copy for further processing, the drum is manually rotated clockwise by means of thumb wheels attached to each end of the drum. When the drum is being rotated, the sheet of copy passes under a window that is cut into the base wall while it is progressively being rolled up on the drum. This allows the copy to be seen and processed a few lines at a time and blocks out the copy that has already passed across the window as well as the copy still to be rotated past it. This feature offers a distinct advantage to the user because it obviates most of the possible repetitive distraction that whole sheets of copy viewed on flat panel copy holders can induce in their users. Because it is relatively low in height, free standing and more compact than flat panel and rotatable prior art copy holders, the disclosed copy holder can more often be placed in the work area conveniently close to the user. When used in conjunction with a computer it may in many situations be placed between the computer keyboard and the computer proper. This is a preferred location because it places the copy in the direct line of sight of the user resulting in less head swivelling and faster work progress.

12 Claims, 2 Drawing Sheets

NON-PASSIVE COPY HOLDER WITH ROTATABLE DRUM

BACKGROUND OF THE INVENTION

1. Field of the Invention

The field of the invention is that of copy holders. This invention pertains to a free standing copy holder with a rotatable drum.

2. Description of the Prior Art

Flat panel and rotatable drum copy holders are well known in the prior art. They are widely used by typists, computer users and others dealing with printed or written reports and other paper work to hold sheets of copy in a convenient position for further processing. Prior art copy holders presently in use are predominantly free standing easels, dimensioned to display information contained on standard size sheets of paper on panels provided with clipboard type clamps to hold the sheets in an upright position.

From the standpoint of maximum convenience and help to the user the most desirable location for a copy holder, if it was possible to locate one there, would be on the desk top in front of the user. In the operation of computers, for example, none of the various prior art copy holders can be placed in the direct line of sight of the operator without spatially interfering either with operation of the keyboard, the disc drives and/or a computer view of the computer monitor.

In many modern keyboard-computer arrangements there is sufficient space available between those elements for the placement of a low profile, narrow base, rotatable drum, copy holder such as the one disclosed herein. That is not to say that the disclosed embodiment will in all cases be usable in the preferred location. For example, laptop and power-book computers do not have any useable space between the computer keyboard and the monitor. In other cases, placing the disclosed copy holder in the preferred location might interfere with the disc drives located in hard drive units in use with many modern computers. However, this possible interference can generally be overcome by moving the disclosed copy holder out of the way momentarily.

In circumstances where the disclosed copy holder can be used in the preferred location it will afford computer operators greater ease in viewing and processing copy for entry into their computers. This invention should also speed up the scanning of copy and should in a limited way make the task of word processing and data entry for computer operators a somewhat less onerous task.

SUMMARY OF THE INVENTION

This disclosure pertains to a free standing copy holder that makes use of a rotatable drum to which a sheet of copy may be clamped in a manner that allows the copy to be completely scanned by manually turning the drum clockwise. Support for the drum while it is being turned is provided by relatively deep circular grooves in the base. The grooves act as bearings for the two end shafts on the drum to which the manual turning knobs are attached. An important characteristic of the disclosed copy holder is that when a sheet of copy is being scanned, the sections already scanned are continually being rolled up on the drum. This is a distinct advantage to the user because the lines of copy already processed will be blocked from repeated view, a distraction that is common to some prior art coy holders. Also, the lines of copy not yet scanned and not showing in the window cut into the base remain hidden from view in the open area beneath the drum.

When the scanning of a sheet of copy is completed, the open grooves on the base allow the drum to be lifted from the base and the sheet of coy detached from the clamping mechanism on the drum. If there are additional sheets of copy to be scanned, they are clamped to the drum in turn and the process repeated. When a user finishes task that required the use of the disclosed copy holder, the empty drum may be rejoined with the base.

The disclosed copy holder is intended to be a free standing accessory to assure that it remains free standing and does not tip over or become displaced during operation, the vacuum cups on the base may be engaged by pressing them down on a smooth portion of the work area. Engaging the vacuum may not be needed if the disclosed copy holder is used in conjunction with a computer that has a separate keyboard. By placing it between the keyboard and the body of the computer, it may be partially supported by either or both of these objects without interference with the computer operation.

BRIEF DESCRIPTION OF THE DRAWINGS

FIG. 2 is an enlarged view of a section on line 2—2 of the semi-circular clamping rod 5, showing also the flattened rectangular end portion of 5. The through hole in the flattened end does not show in FIG. 2.

DESCRIPTION OF THE PREFERRED EMBODIMENT

Figure 1:
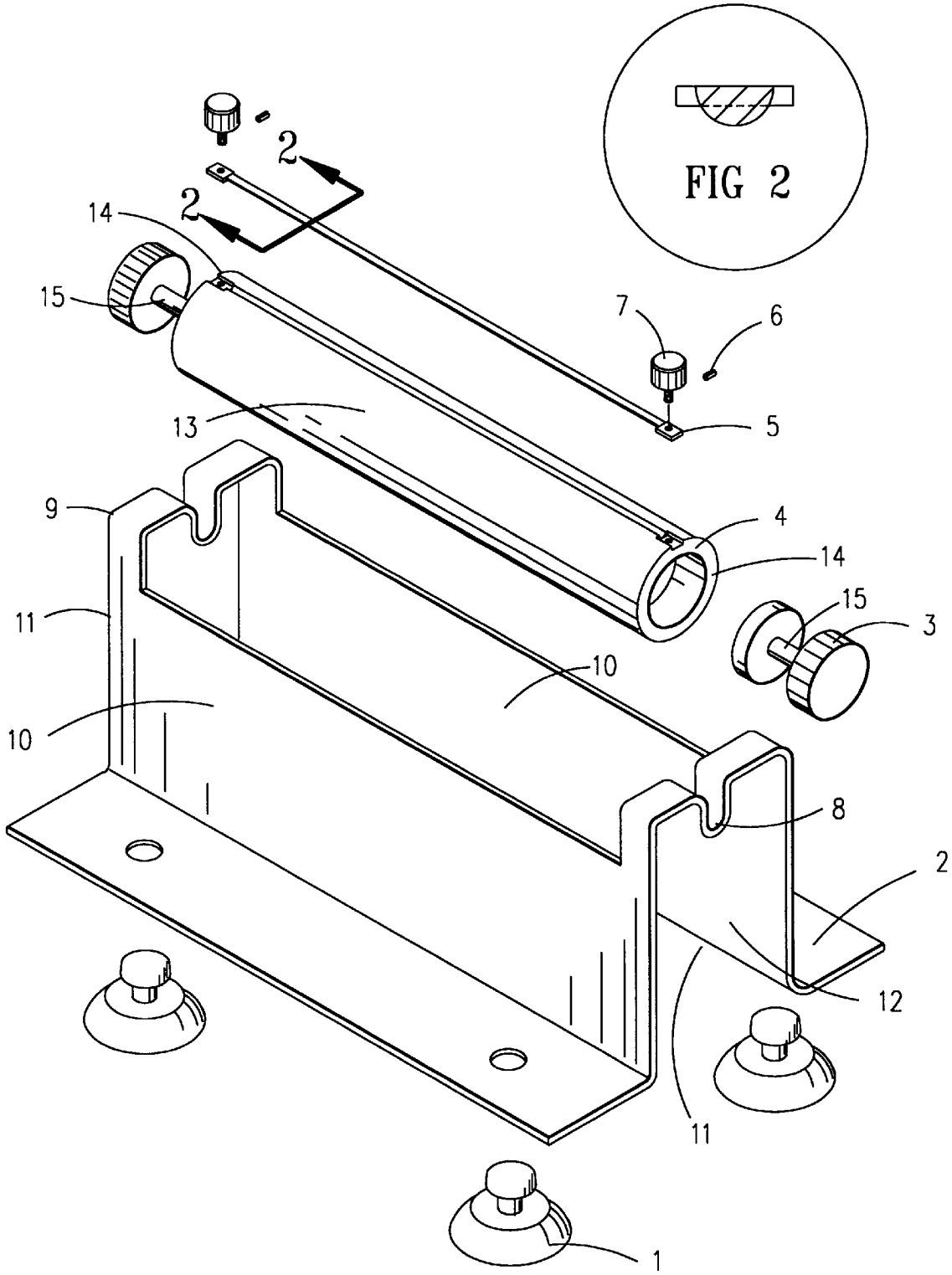
FIG. 1 shows an exploded projection of all of the parts of the embodiment ready for assembly.

FIG. 1 of the drawings show the parts of the embodiment 30 before assembly. The base 2 is provided with outwardly facing flanges for maximum stability as it is essential that the embodiment remain upright during operation. As added assurance for working stability, four vacuum cups 1, of rubber or similar material, are provided. They attach through four holes located the base flanges. They may be engaged on a smooth work surface if needed. This may become necessary when the drum 4 is being rotated manually with one hand, a form of use that may tend to move the disclose copy holder out of position when it is used on a relatively frictionless surface. The assembly of 1 with 2 constitutes the complete base.

Referring again to FIG. 1, the assembly of 4 with its component parts is accomplished as follows. Paper clamp 5 is assembled to 4 by placing its half-round side in the half-round groove in 4 with the flat side facing up. Thumb screws 7 are passed through the hole in each flat end of 5 and threaded through the matching tapped holes in 4 to a maximum depth in the bore in each end of 4. That position allows roll pin 6 to be pressed into a through hole close to the bottom end of the threaded portion of 7. When 6 protrudes equally on each side of 7, it will captivate 7 to the extent that it cannot be reverse threaded out of 4. This is the design objective because separation of 7 from the drum assembly would render 5 inoperable.

Next assembled with 4 are the thumb wheel subassemblies 3. The cylindrical bottom discs of 3 are attached in the subassembly concentrically by short lengths of shaft to the thumb wheels proper. Subassemblies 3 are assembled with 4 by pressing its bottom disc into the concentric bore on 4 to the depth of its thickness. When each end disc is permanently secured concentrically inside one of two opposing bored ends 14 of rotatable portion 13 of 4 by adhesive or other means, smooth end closures of 4 results. Also when 3 is assembled to 4 in this manner, the shafts on 3 connecting to the thumb wheels will protrude equally spaced on each side of 4. The assembly of 3 with 4 completes the drum assembly. When shaft portion 15 of drum 4 is placed in the open grooves 8 at the top bridges 9 of 2 bridging opposing ends 11 of opposing sidewalls 10 which form inverted channel 12, assembly of the embodiment will be complete.

Although the grooves on the top of 2 are intended as bearing surfaces, no special provisions against friction have been provided because of the slow rate at which 4 will be turned during scanning. The grooves are also somewhat deeper than they need to be to contain the end shafts portion 15 of 4. The extra depth of the grooves should keep the end shafts from inadvertently coming out of the grooves when the drum is being turned.

The width of 4 is dimensioned to be wide enough to receive and secure with a small amount of space to spare within its clamping means a standard 8½"×11" sheet of paper. If a sheet of paper which is longer than 11 inches is clamped to 4, the extra length will not interfere with the proper operation of the disclosed copy holder because both the drum and the base holder are designed to accept extra long or extra short sheets of paper. The drum 4 has a design circumference of 1⅝ inches; seven or eight clockwise turns of 4 will scan an entire sheet of 8½"×11" copy clamped to its surface.

Figure 3:
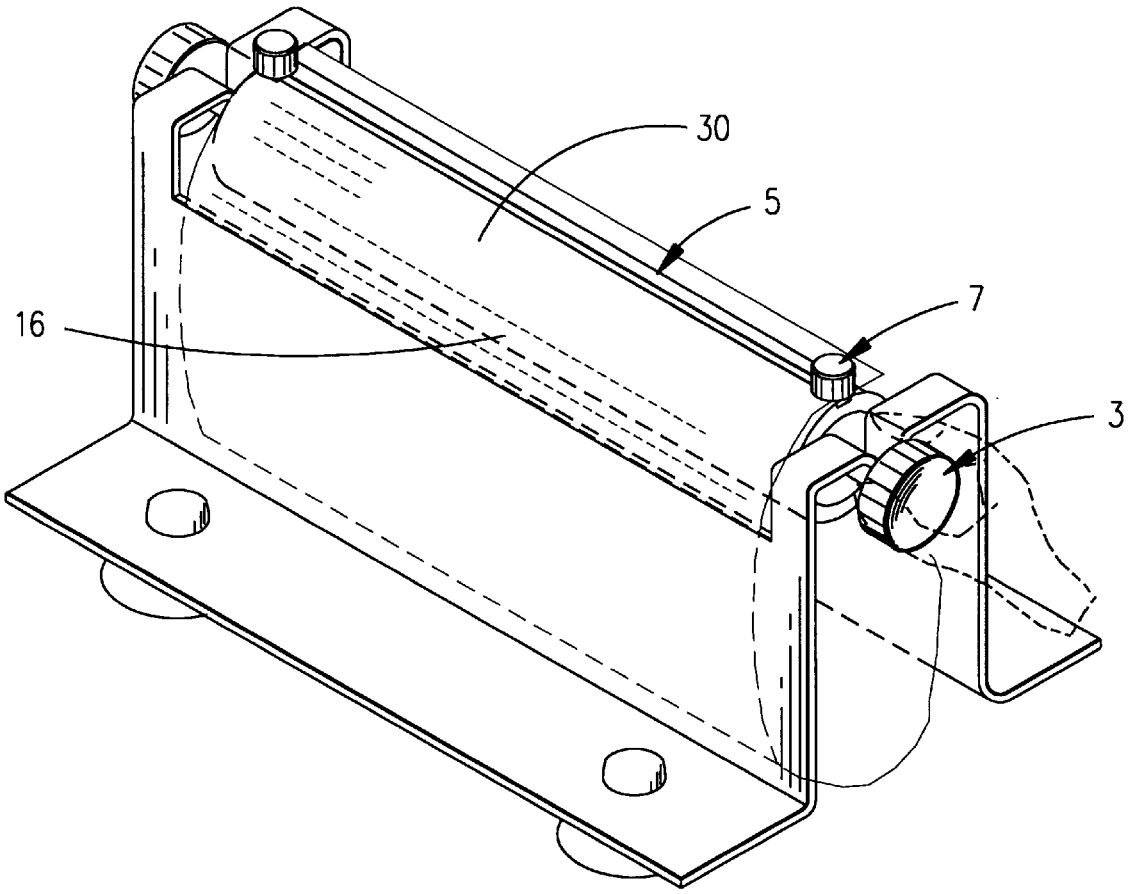
FIG. 3 shows a projection of the embodiment, 30, completely assembled, with a simulated sheet of copy clamped in place ready to be scanned.

One advantage of using the disclosed rotatable drum copy holder over other prior art embodiments is that portions of copy already scanned are continuously being rolled up on the drum and become hidden from the view of the user. Duplicate scanning of copy and distraction from viewing too many lines of copy at one time cannot not occur because of this. Another advantage of the rotary design of the drum 4 is that the base 2 is designed with a viewing window 16 cut into the wall past which unscanned portions of copy first appear as the drum is being advanced clockwise. The beneficial effect of the window in the base is illustrated in FIG. 3, which shows how lines of new copy appear in the window when the drum is turned. If a user has to interrupt a scanning operation to do something more urgent, the stopping place will not be lost because the portion of copy appearing in the window will likely be the point where the scanning was interrupted.

Consideration has been given to the various thicknesses encountered in office paper and business forms in the design of the paper clamp on 4. The half-round clamp rod 5 that is part of the clamp assembly has design diameter of ⅛ inch. the diameter of the groove in 4, that mates with 5 to provide the clamping means, is dimensioned to exceed by several millimeters the ⅛ inch half-round diameter of 5. The difference in diameters between the groove in 4 and the diameter of 5 will approximate the average expected maximum thickness of sheets of copy which computer operators, typists and others encounter in their work.

To further assure a neat, minimally protruding roll-up for sheets of copy that are clamped to 4, the top surface of clamping rode 5 is flat. An enlarged section through 5 is shown in FIG. 2. This configuration creates a clamp rod that fits neatly into the half-round groove in 4, thereby assuring that sheets of copy will remain effectively secured to 4 as it is being rotated.

Consideration as to cost effectiveness, ease of operation and ease of manufacture were given to other possible designs before the present configuration of the drum 4 and the clamping means 5, 6 and 7 and the base 2 were adopted. It is envisioned that other possible drum and clamping arrangements and base configuration can be adapted to the overall design objectives of a rotatable drum copy holder and they do not limit any final manufacturing design to the one disclosed and claimed herein.

The assembled embodiment 30, with the top of a simulated sheet of copy attached to the drum is shown in FIG. 3. This Figure also shows the drum properly seated in the bearing grooves in the base. Also shown are the vacuum cups on the base flattened out and engaged. The bottom portion of a simulated sheet of copy is shown in the Figure loosely tucked into the open space below the drum. That is the normal placement of a sheet of copy ready to be scanned. Scanning is accomplished by turning the thumb wheels 3 clockwise at a rate determined by the user.

FIG. 3 also shows how the loose, unclamped portion of a new sheet of copy is placed loosely rolled under the drum 4 before the scanning and roll-up of the sheet of copy beings. As the scanning progresses, sections of copy already scanned will neatly roll up on the drum. After the scanning is completed, the drum may be removed from the based and the sheet of copy detached. This is accomplished by unrolling the sheet of copy from the drum as far as the top margin and loosening the finger operated clamping screws. A new sheet of copy may now be affixed to the copy holder.

We claim:

1. A copy holder for holding a copy and for use on a surface, comprising, a uniform, free-standing base, comprising an inverted channel having two opposing ends and a longitudinal axis running through said ends, said channel comprising, two or more opposing walls between said opposing ends substantially perpendicular to said surface;

a substantially open top; and a bridge traversing said open top proximate each of said ends; and one or more grooves in each of said bridges;

a drum having two opposing ends and a longitudinal axis running through said ends, comprising, a rotatable portion having two opposing ends;

at least one wheel proximate at least one of said ends of said rotatable portion;

at least one shaft portion fixed to and between said rotatable portion and said wheel, and seated in said groove; and a means for removably holding at least a portion of said copy against said rotatable portion;

wherein said axis of said channel and said axis of said drum are substantially parallel to each other.

2. The copy holder of claim 1, wherein at least one of said walls has a bottom edge, further comprising at least one flange fixed proximate and substantially perpendicular to at least one of said bottom edges of said walls.

3. The copy holder of claim 2, further comprising a means for removably fixing said flange to said surface.

4. The copy holder of claim 2, wherein said flange is an integral part of said uniform base.

5. The copy holder of claim 2, wherein said means for removably fixing said flange to said surface comprises a plurality of vacuum cups.

6. The copy holder of claim 1, wherein said means for removably holding said copy comprises a clamp releasably attached to said drum proximate at least one of said two opposing ends of said rotatable portion.

7. The copy holder of claim 1, wherein a portion of said open top further comprises a viewing portion extending downward in at least one of said walls between said bridges.

8. The copy holder of claim 1, wherein said rotatable portion further comprises at least one groove between said ends of said rotatable portion and wherein said means for removably holding said copy comprises a clamp with a protrusion corresponding to said groove in said rotatable portion.

9. A free-standing copy holder for use on a surface between a computer monitor and a keyboard, comprising, two opposing walls, substantially perpendicular to said surface, each having two corresponding ends, and connected to each other by at least two opposing bridges each located on said corresponding ends of said walls, respectively, forming a viewing window in at least one of said walls between said bridges, wherein at least one half-round groove is provided in each of said bridges;

one or more flanges fixed proximate to a bottom portion of at least one of said walls;

an elongated drum having two opposing ends and a shaft at each of said opposing ends, wherein a portion of each shaft is removably seated in one of said grooves in each of said bridges; and a means for holding a copy against said drum.

10. The free-standing copy holder of claim 9, wherein said walls have a low profile so that said walls do not obscure a view of said computer monitor.

11. The free-standing copy holder of claim 9, further comprising a means for removably fixing said flanges to said surface.

12. The free-standing copy holder of claim 11, wherein said means for removably fixing said flanges comprises a plurality of vacuum cups.

* * * * *